US006736310B1

(12) United States Patent
Mesol

(10) Patent No.: US 6,736,310 B1
(45) Date of Patent: May 18, 2004

(54) SECURED MAILBOX ASSEMBLY

(76) Inventor: Michael A. Mesol, 7104 Fountain Rock Way, Columbia, MD (US) 21046

( * ) Notice: Subject to any disclaimer, the term of this patent is extended or adjusted under 35 U.S.C. 154(b) by 0 days.

(21) Appl. No.: 10/372,511

(22) Filed: Feb. 25, 2003

(51) Int. Cl.[7] ..... B65D 91/00
(52) U.S. Cl. ..... 232/39; 232/45
(58) Field of Search ..... 232/39, 45, 47, 232/17; 248/146, 218.4, 156, 221.11, 220.21

(56) References Cited

U.S. PATENT DOCUMENTS

| | | | | | |
|---|---|---|---|---|---|
| 446,257 | A | * | 2/1891 | Lane | 232/33 |
| 519,427 | A | * | 5/1894 | Groff | 232/39 |
| 1,480,452 | A | * | 1/1924 | Kolstad | 232/17 |
| 3,880,344 | A | | 4/1975 | Earle | |
| 4,367,844 | A | * | 1/1983 | Drummond | 232/17 |
| 4,753,386 | A | | 6/1988 | Phillion, Sr. | |
| 4,905,891 | A | | 3/1990 | Wildish et al. | |
| 5,060,908 | A | * | 10/1991 | Sofy | 248/545 |
| 5,096,115 | A | | 3/1992 | Hassan | |
| 5,148,974 | A | | 9/1992 | Clapper | |
| 5,351,883 | A | * | 10/1994 | Pachl | 232/17 |
| 5,526,979 | A | * | 6/1996 | Mann | 232/33 |
| 5,617,993 | A | * | 4/1997 | Morris | 232/27 |
| 5,664,748 | A | * | 9/1997 | Speece et al. | 248/219.2 |
| 5,833,132 | A | | 11/1998 | Bachmeier | |
| 6,378,768 | B1 | * | 4/2002 | Belloise | 232/39 |

* cited by examiner

*Primary Examiner*—William L. Miller

(57) ABSTRACT

A secured mailbox assembly for preventing the theft of mail placed inside a user's mailbox. The secured mailbox assembly includes an elongate base member being adapted to be partially disposed in a ground; and also includes a mailbox including a bracket being fastened with fasteners to the elongate base member, and also including a container being attached to the bracket, and further including a mail delivery door being hingedly attached to the container, and also including a mail retrieval door also being hingedly attached to the container, and further including a mail chute being attached to the mail delivery door; and further includes a lock mechanism for locking the mail receiving door to said container.

7 Claims, 4 Drawing Sheets

SECURED MAILBOX ASSEMBLY

BACKGROUND OF THE INVENTION

1. Field of the Invention

The present invention relates to security mailboxes and more particularly pertains to a new secured mailbox assembly for preventing the theft of mail placed inside a user's mailbox.

2. Description of the Prior Art

The use of security mailboxes is known in the prior art. More specifically, security mailboxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,880,344; U.S. Pat. No. 4,753,386; U.S. Pat. No. 4,905,891; U.S. Pat. No. 5,833,132; U.S. Pat. No. 5,148,974; and U.S. Pat. No. 5,096,115.

While these devices fulfill their respective, particular objectives and requirements, the aforementioned patents do not disclose a new secured mailbox assembly. The prior art includes mailboxes having containers and doors for delivering and receiving one's mail.

SUMMARY OF THE INVENTION

The general purpose of the present invention, which will be described subsequently in greater detail, is to provide a new secured mailbox assembly which has many of the advantages of the security mailboxes mentioned heretofore and many novel features that result in a new secured mailbox assembly which is not anticipated, rendered obvious, suggested, or even implied by any of the prior art security mailboxes, either alone or in any combination thereof. The present invention includes an elongate base member being adapted to be partially disposed in a ground; and also includes a mailbox including a bracket being fastened with fasteners to the elongate base member, and also including a container being attached to the bracket, and further including a mail delivery door being hingedly attached to the container, and also including a mail retrieval door also being hingedly attached to the container, and further including a mail chute being attached to the mail delivery door; and further includes a lock mechanism for locking the mail receiving door to said container. None of the prior art includes the combination of the elements of the present invention.

There has thus been outlined, rather broadly, the more important features of the secured mailbox assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new secured mailbox assembly which has many of the advantages of the security mailboxes mentioned heretofore and many novel features that result in a new secured mailbox assembly which is not anticipated, rendered obvious, suggested, or even implied by any of the prior art security mailboxes, either alone or in any combination thereof.

Still another object of the present invention is to provide a new secured mailbox assembly for preventing the theft of mail placed inside a user's mailbox.

Still yet another object of the present invention is to provide a new secured mailbox assembly that is easy and convenient to set up and use.

Even still another object of the present invention is to provide a new secured mailbox assembly that safeguards mail being placed in one's standalone mailbox as primarily found in rural areas.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
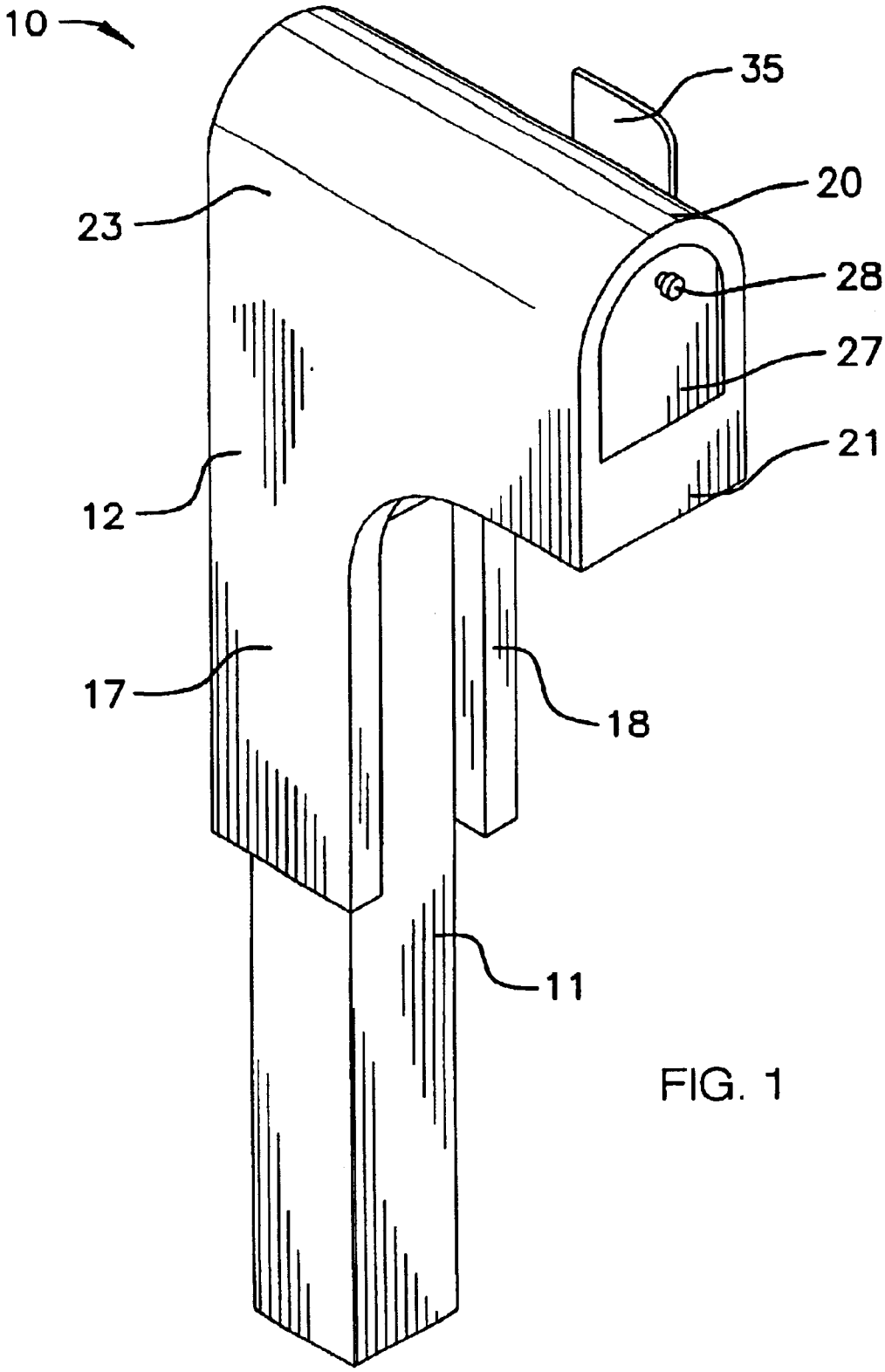
FIG. 1 is a front perspective view of a new secured mailbox assembly according to the present invention.
Figure 2:
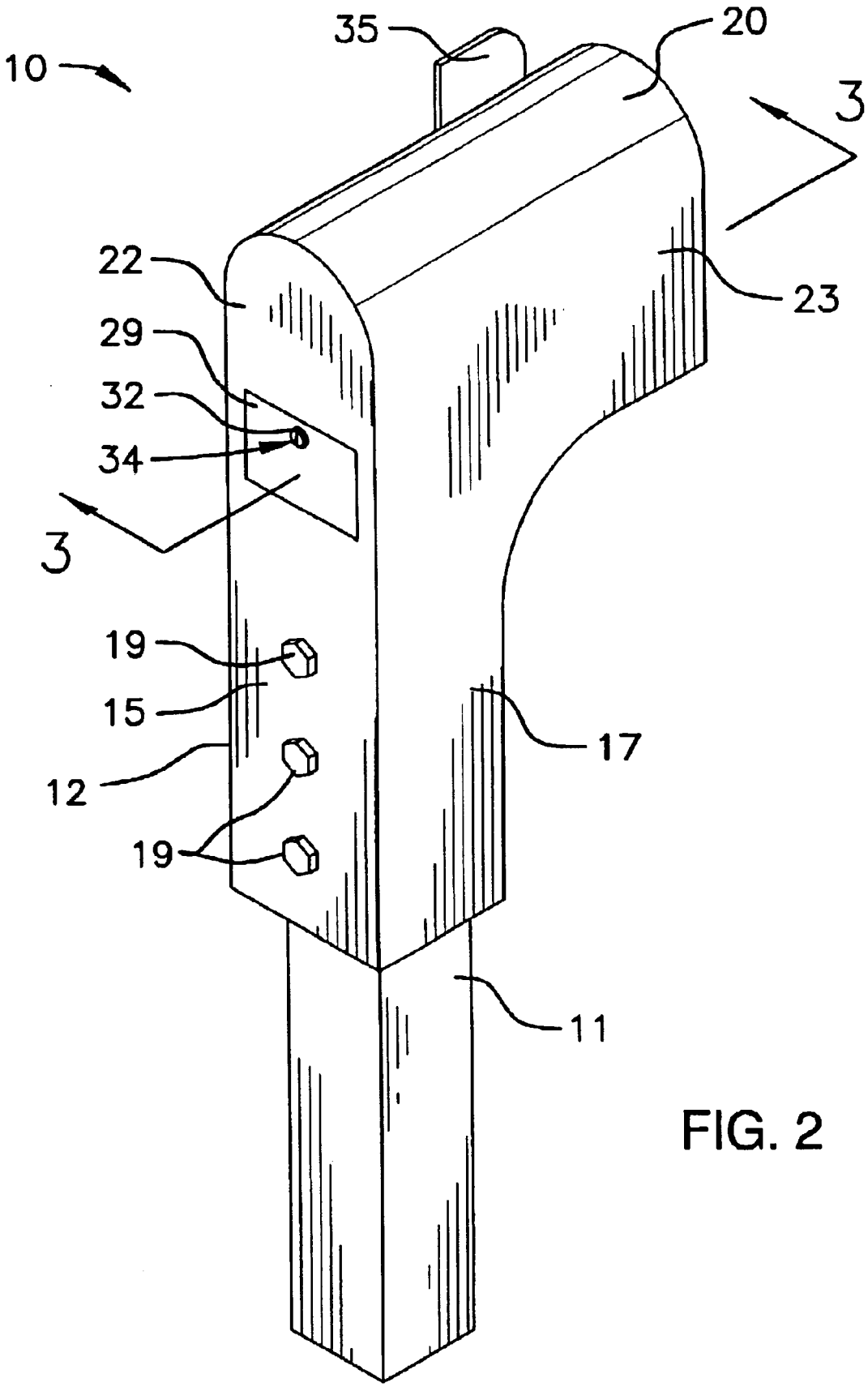
FIG. 2 is a rear perspective view of the present invention.
Figure 3:
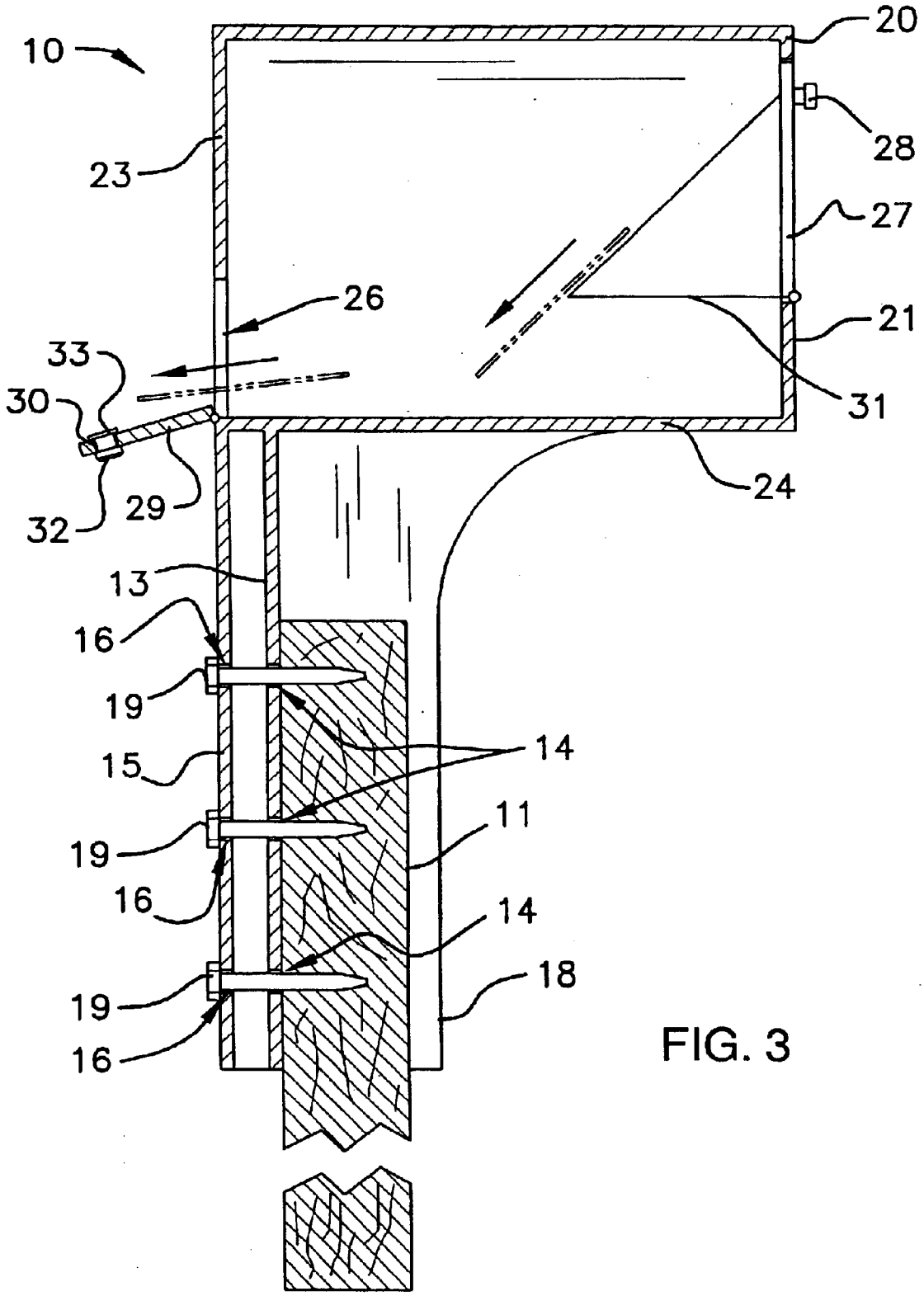
FIG. 3 is a cross-sectional view of the present invention.
Figure 4:
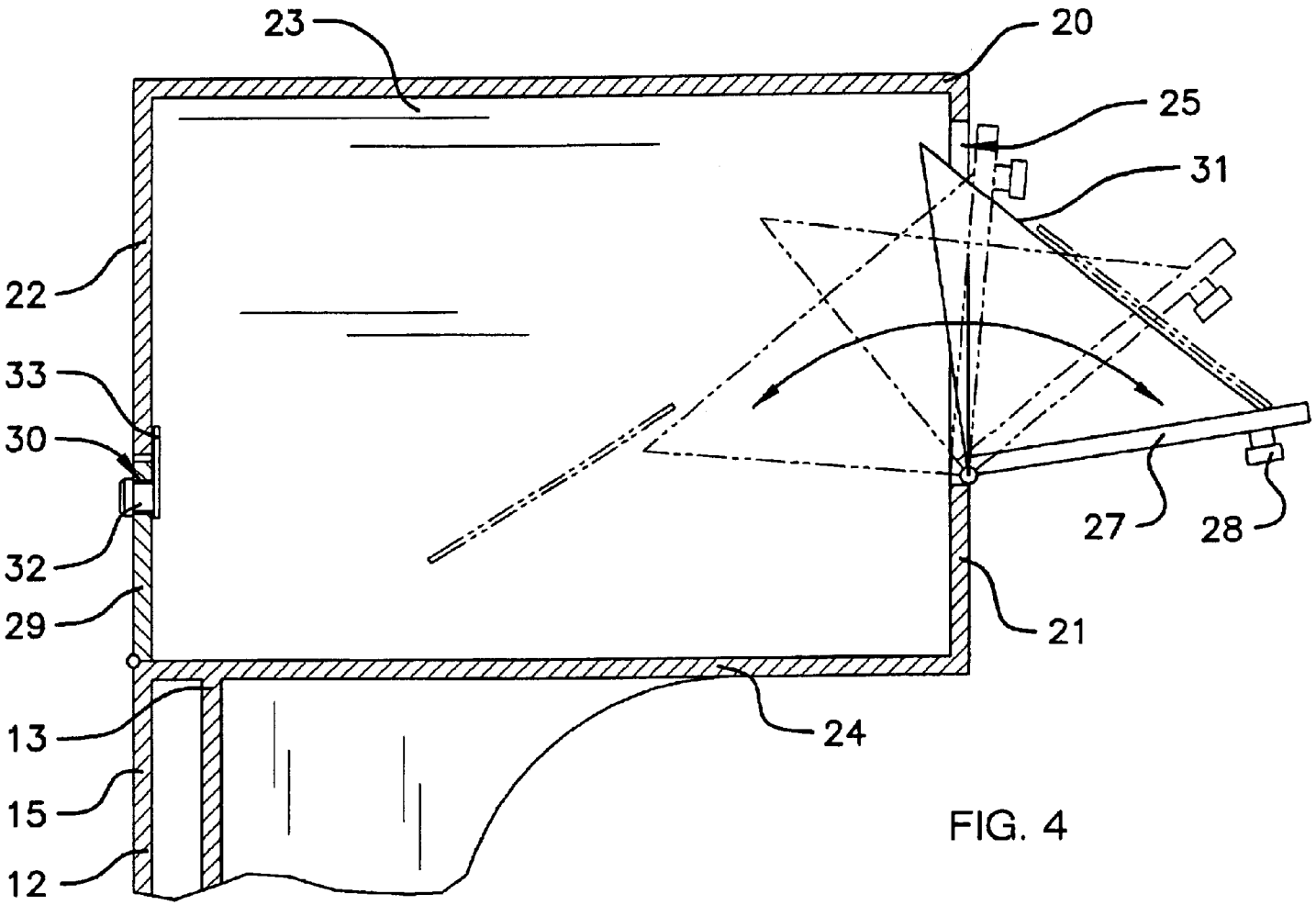
FIG. 4 is a detailed partial cross-sectional view of the present invention.

With reference now to the drawings, and in particular to FIGS. 1 through 4 thereof, a new secured mailbox assembly embodying the principles and concepts of the present invention and generally designated by the reference numeral 10 will be described.

As best illustrated in FIGS. 1 through 4, the secured mailbox assembly 10 generally comprises an elongate base member 11 being adapted to be partially and securely embedded in a ground. The elongate base member 11 is a post which is adapted to be vertically erected upon the ground.

A mailbox includes a bracket 12 being fastened with fasteners 19 to the elongate base member 11, and also includes a container 20 being integrally attached to the bracket 12, and further includes a mail delivery door 27 being hingedly and securely attached by any means to the container 20, and also includes a mail retrieval door 29 also being hingedly and securely attached by any means to the container 20, and further includes a mail chute 31 being securely attached to the mail delivery door 27. The bracket 12 includes elongate inner and outer main walls 13,15 being spaced apart and being integrally and securely attached to the container 20 and having holes 14,16 being disposed therethrough for supporting and stabilizing the container 20, and also includes elongate side walls 17,18 being integrally disposed along longitudinal edges of the elongate inner and outer main walls 13,15 with the fasteners 19 being disposed through the holes 14,16 of the elongate inner and outer main walls 13,15 and being extended into the post 11 for securing the mailbox to the post 11. The container 20 has top, side, front and back walls 21–24, and also has a mail delivery opening 25 being disposed through the front wall 21, and further has a mail retrieval opening 26 being disposed through the back wall 22. The mail delivery door 27 has a bottom edge which is hingedly and securely attached to a bottom edge forming the mail delivery opening 25 in the container 20, and also has a front side and a back side with a handle 28 being securely attached by any means to the front side thereof for opening and closing the mail delivery door 27. The mail retrieval door 29 has a hole 30 being disposed therethrough. The mail chute 31 includes a right triangular-shaped body having a side wall which is formed by the back side of the mail delivery door 27, and also having a hypotenuse side upon which mail is placed and slides into the container 20. The mailbox further includes a mail pickup flag 35 being securely attached to an outer side of one of the side walls 23 of the container 20.

A lock mechanism 32–34 for locking the mail retrieval door 29 to the container 20. The lock mechanism 32–34 includes a lock body 32 being securely and engageably disposed in the hole 30 of the mail retrieval door 29, and also includes a latch 33 being pivotally attached to a back end of the lock body 32 and being engageable to an inner side of the back wall 22 of the container 20, and further includes a key slot 34 being disposed in a front end of the lock body 32 for receiving a key to lock and lock the mail retrieval door 29.

In use, the mail delivery person would open the mail delivery door 27 to place mail in the container 20 by simply allowing the mail to slide into the container 20 along the mail chute 31 which also prevents and blocks anybody from extending one's hand into the container 20 through the mail delivery opening 25. The user can retrieve one's mail by simply unlocking the mail retrieval door 29 which allows the user to extend one's hand into the container 20 to retrieve one's mail. Once the mail is retrieved, the user simply closes and locks the mail retrieval door 29 to the container 20 to prevent unauthorized access to the user's mailbox.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the secured mailbox assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A secured mailbox assembly comprising:

an elongate base member being adapted to be partially embedded in a ground, said elongate base member being a post which is adapted to be vertically-erected upon the ground;

a mailbox including a bracket being fastened with fasteners to said elongate base member, and also including a container being attached to said bracket, and further including a mail delivery door being hingedly attached to said container, and also including a mail retrieval door also being hingedly attached to said container, and further including a mail chute being attached to said mail delivery door, said bracket including elongate inner and outer main walls being spaced apart and being integrally attached to said container and having holes being disposed therethrough for supporting and stabilizing said container, and also including elongate side walls being disposed along longitudinal edges of said elongate inner and outer main walls, said fasteners being disposed through said holes of said elongate inner and outer main walls and being extended into said post for securing said mailbox to said post; and a lock mechanism for locking said mail receiving door to said container.

2. The secured mailbox assembly as described in claim 1, wherein said container has top, side, front and back walls, and also has a mail delivery opening being disposed through said front wall, and further has a mail retrieval opening being disposed through said back wall.

3. The secured mailbox assembly as described in claim 2, wherein said mail delivery door has a bottom edge which is hingedly attached to a bottom edge forming said mail delivery opening in said container, and also has a front side and a back side with a handle being attached to said front side thereof for opening an closing said mail delivery door.

4. The secured mailbox assembly as described in claim 3, wherein said mail retrieval door has a hole being disposed therethrough.

5. The secured mailbox assembly as described in claim 4, wherein said mail chute includes a right triangular-shaped body having a side wall which is formed by said back side of said mail delivery door, and also having a hypotenuse side upon which mail is placed and slides into said container.

6. The secured mailbox assembly as described in claim 5, wherein said lock mechanism includes a lock body being disposed in said hole of said mail retrieval door, and also including a latch being pivotally attached to back end of said lock body and being engageable to an inner side of said back wall of said container, and further includes a key slot being disposed in a front end of said lock body.

7. The secured mailbox assembly as described in claim 6, wherein said mailbox further includes a mail pickup flag being attached to an outer side of one of said side walls of said container.

* * * * *